US008007263B2

(12) United States Patent
Yoshimura et al.

(10) Patent No.: US 8,007,263 B2
(45) Date of Patent: Aug. 30, 2011

(54) WATER-LUBRICATED COMPRESSOR

(75) Inventors: Shoji Yoshimura, Takasago (JP); Akinori Tamura, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 422 days.

(21) Appl. No.: 12/333,737

(22) Filed: Dec. 12, 2008

(65) Prior Publication Data

US 2009/0185938 A1 Jul. 23, 2009

(30) Foreign Application Priority Data

Jan. 21, 2008 (JP) ..... 2008-010505

(51) Int. Cl.
*F03C 2/00* (2006.01)
*F03C 4/00* (2006.01)
*F04C 15/00* (2006.01)

(52) U.S. Cl. ..... 418/84; 418/83; 418/85; 418/87; 418/97; 418/201.1; 417/26; 417/228; 417/310; 184/6.4; 184/6.16

(58) Field of Classification Search ..... 418/83–85, 418/87, 97, 201.1, 270, DIG. 1; 417/26, 417/63, 228, 243, 310; 184/6.4, 7.4, 6.16, 184/6.17
See application file for complete search history.

(56) References Cited

U.S. PATENT DOCUMENTS 3,759,348 A * 9/1973 Kasahara ..... 418/84
4,275,570 A * 6/1981 Szymaszek et al. ..... 62/468
5,318,151 A * 6/1994 Hood et al. ..... 418/84
6,139,280 A * 10/2000 Holt et al. ..... 417/26
6,722,858 B2 * 4/2004 Yoshimura et al. ..... 418/DIG. 1
7,033,144 B2 * 4/2006 Yoshimura et al. ..... 417/228
7,094,037 B2 * 8/2006 Nakamura et al. ..... 417/228

FOREIGN PATENT DOCUMENTS

JP 04008893 A * 1/1992 ..... 418/85
JP 06213188 A * 8/1994 ..... 418/85
JP 2000045936 A * 2/2000
JP 2001-263242 9/2001
KR 1020070012600 A * 10/2007
WO WO 2005/035989 A1 4/2005

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A water-lubricated compressor has a discharge on-off valve in a discharge channel located between a discharge port of a compressor body and a water separating/recovering unit. A water circulation on-off valve is disposed in a water circulation channel located between a water cooler and a water supply portion in the compressor body. A gas release channel provides communication between a gas phase portion of the water separating/recovering unit and the exterior of the water separating/recovering unit. A gas release on-off valve is disposed in the gas release channel. When the compressor body is not in operation, the discharge on-off valve and the water circulation on-off valve are closed and the gas release on-off valve is opened, allowing water to be recovered to the water separating/recovering unit. When there is no demand for compressed gas, it is possible to remove water from the water cooler, which otherwise may be damaged.

8 Claims, 5 Drawing Sheets

WATER-LUBRICATED COMPRESSOR

BACKGROUND OF THE INVENTION

1. Field of the Invention

The present invention relates to a water-lubricated compressor capable of preventing freezing of water by discharging water from a water cooler disposed in a water circulation channel of the compressor when there is little or no demand for compressed gas at a compressed gas destination, i.e., a place to which compressed gas is to be supplied.

2. Description of the Related Art

The temperature of screw rotors (hereinafter referred to also as "rotors") of a screw compressor rises as gas sucked from a suction port is compressed within a rotor chamber. Therefore, a cooling mechanism for cooling the screw rotors is essential. Heretofore, as such a cooling mechanism, there has generally been adopted a cooling mechanism wherein cooling liquid is supplied to the rotor chamber with the screw rotors accommodated therein. As a typical example of a screw compressor using such a cooling mechanism, there is known an oil-cooled screw compressor using oil as the aforesaid cooling liquid. The oil supplied to the rotor chamber not only functions to cool a gas compressing section but also functions to seal and lubricate between the screw rotors and also between the screw rotors and an inner wall of the rotor casing.

In case of using oil as the cooling liquid, the oil is separated and recovered from compressed gas by an oil separating/recovering unit disposed in a discharge channel formed in a compressor body, but a portion of the oil is carried as oil mist to a compressed gas destination together with discharged compressed gas. As a result, in a compressed gas destination requiring clean compressed gas, for example in a manufacturing process for manufacturing electronic parts such as semiconductors, precision machines or foods, there has been the problem that the oil in question adheres to mechanical parts or products associated with the manufacturing process and causes contamination.

In an effort to solve this problem, there has been developed an oil-free compressor which can operate in a dry condition not using oil. In this oil-free compressor, however, there has been the problem that the compression efficiency is greatly deteriorated in a low speed rotation range of the compressor, even if there is made an inverter control as an example. In view of these problems, a water-lubricated compressor using water as cooling liquid has been developed. In the water-lubricated compressor, water is used instead of oil and is allowed to fulfill the functions of cooling, sealing and lubricating. Since it is possible to prevent leakage of gas in the compressing process, a highly efficient compressing action is attained in an overall speed range from low to high speed range and there is obtained a discharge volume of about 30% or more in comparison with that in the dry type.

As in the foregoing conventional oil-cooled compressor, the water used in the water-lubricated compressor is separated and recovered by a water separating/recovering unit which corresponds to the oil separating/recovering unit disposed in the discharge channel, and the water thus recovered is again supplied to the compressor through a water circulation channel. However, when there is little or no demand for compressed gas in the compressed gas destination during the winter season, a water systems including the water separating/recovering unit and the water circulation channel may become frozen, giving rise to a trouble such as breakage.

Now, with reference to FIG. 5 attached hereto, a description will be given about a conventional technique to prevent the aforesaid freezing of water systems in the water-lubricated compressor. FIG. 5 is a front see-through diagram of a water jet compressor having a conventional antifreezing device. According to the conventional antifreezing method in a water jet compressor, two openings are formed in a package 20 and a cover 46 for covering the openings is attached to an outer wall of the package, thereby forming a circulation channel 47, the circulation channel 47 having an inlet port 44 for introduction of air present within the package 20 and a release port 45 for releasing heated air into the package 20, further, air circulating means 42, e.g., an air fan, and heating means 43, e.g., an electric heater, are installed within the circulation channel 47 to circulate heated air through the interior of the package (see Japanese Patent Laid-Open Publication No. 2001-263242).

In the above conventional antifreezing technique it is necessary that the air present within the package be circulated by air circulating means such as a fan for example. However, since a large number of constituent parts are accommodated complicatedly within the package, it is difficult to let the air present within the package circulate thoroughly without stagnation. Thus, according to such an antifreezing method, it is difficult to maintain a constant heating temperature for the entire water system and hence there is a fear that a device particularly apt to be damaged by freezing of water, i.e., a water cooler, may be locally frozen and result in breakage.

SUMMARY OF THE INVENTION

Accordingly, it is an object of the present invention to provide a water-lubricated compressor which, without using an electric heater or a fan, can remove water from a water cooler which is particularly apt to be damaged by freezing of water among the water system of the compressor, and can consequently prevent freezing of water, when there is little or no demand for compressed gas in a compressed gas destination.

According to the present invention, for achieving the above-mentioned object, there is provided a water-lubricated compressor comprising a compressor body; a water separating/recovering unit disposed in a discharge channel of the compressor body; a water circulation channel for supplying water separated by the water separating/recovering unit to a water supply portion in the compressor body; a water cooler disposed in the water circulation channel; a discharge on-off valve disposed in the discharge channel at a position between a discharge port of the compressor body and the water separating/recovering unit; a water circulation on-off valve disposed in the water circulation channel at a position between the water cooler and the water supply portion in the compressor body; a gas release channel providing communication between a gas phase portion of the water separating/recovering unit and the exterior of the water separating/recovering unit; a gas release on-off valve disposed in the gas release channel; and a controller adapted to make control so as to open the discharge on-off valve and the water circulation on-off valve and close the gas release on-off valve when the compressor body is in operation, and so as to close the discharge on-off valve and the water circulation on-off valve and open the gas release on-off valve when the compressor body is not in operation.

According to the water-lubricated compressor of the above structure, since the discharge on-off valve and the water circulation on-off valve are opened and the gas release on-off valve is closed when the compressor body is in operation, and the discharge on-off valve and the water circulation on-off valve are closed and the gas release on-off valve is opened when the compressor body is not in operation, the water present within the water cooler can be recovered into the water separating/recovering unit through the water circulation channel. Thus, water can be removed from the water cooler which is particularly apt to be damaged by freezing of water among the devices disposed in the water circulation channel, that is, it is possible to avoid the occurrence of a trouble such as breakage of the water cooler caused by freezing of water.

In the water-lubricated compressor of the present invention, discharge stop means may be disposed in the discharge channel succeeding the water separating/recovering unit. The discharge stop means may be constituted by an on-off valve which closes the discharge channel when the compressor body is not in operation or a check valve which is opened so that the compressed gas flows in only the discharge direction of the discharge channel. With such a structure, the compressed gas present within the water system comprising the water separating/recovering unit, the water cooler and the water circulation channel is released through the gas release channel and consequently the water present within the water system is recovered by the water separating/recovering unit. At this time, even if the amount of the recovered water exceeds the capacity of a water pool portion in the water separating/recovering unit, the water is conducted to the gas release channel side and is released to the exterior of the system without flowing toward the discharge channel.

In the water-lubricated compressor of the present invention, a water inlet of the water cooler may be formed on a bottom side of the cooler, and the water circulation channel in the water cooler may become higher or horizontal toward a downstream side. With this structure, water can be removed substantially positively from the water circulation channel formed within the water cooler.

In the water-lubricated compressor of the present invention, a water outlet of the water cooler may be formed on a top side of the cooler. With this structure, water can be removed positively from the water circulation channel formed within the water cooler.

The water-lubricated compressor of the present invention may further comprise a bypass channel for communication between the water circulation channel located between the water separating/recovering unit and the water cooler and the water circulation channel located between the water cooler and the water circulation on-off valve and a bypass on-off valve disposed in the bypass channel, and the controller may open the bypass on-off valve when the compressor body is not in operation. With this structure, the water present within the water cooler is recovered by the water separating/recovering unit and positive removal of water from the water cooler can be done more effectively irrespective of the positions of water inlet and water outlet of the water cooler or the layout and structure of the water circulation channel formed within the water cooler.

DESCRIPTION OF THE PREFERRED EMBODIMENTS

Figure 1:
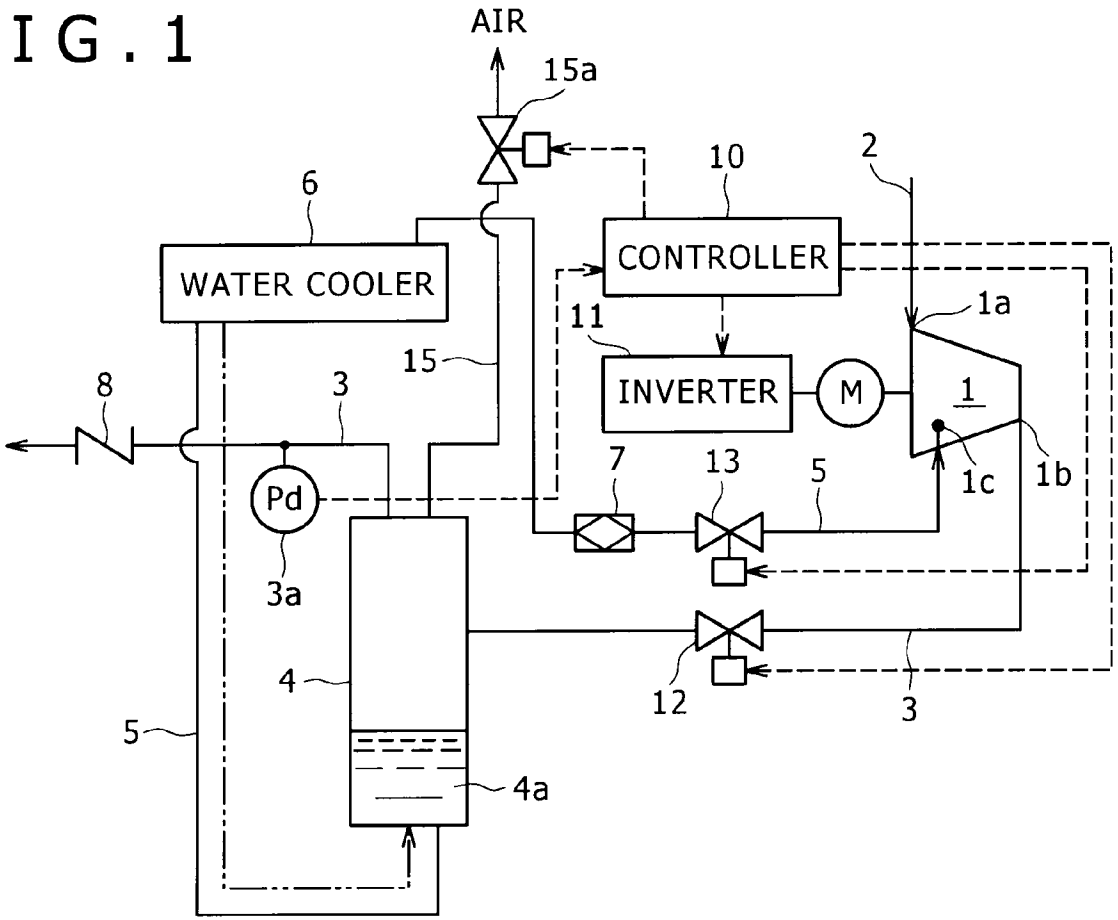
FIG. 1 is a schematic system diagram for explaining a water-lubricated compressor according to a first embodiment of the present invention.

A water-lubricated compressor according to a first embodiment of the present invention will be described below with reference to FIG. 1 attached hereto. FIG. 1 is a schematic system diagram for explaining the water-lubricated compressor of the first embodiment.

The water-lubricated compressor of the first embodiment includes a compressor body 1 having a rotor chamber formed in the interior of a rotor casing, with a pair of male and female screw rotors (not shown) being in mesh with each other and accommodated rotatably within the rotor chamber. A suction channel 2 is connected to a suction port 1*a* of the compressor body 1, while one end side of a discharge channel 3 is connected to a discharge port 1*b* of the compressor body. One of the pair of male and female screw rotors which constitute the compressor body 1, only the male rotor is connected to a drive shaft of a drive motor M. The screw rotors are rotated with the drive motor M, thereby gas supplied from the suction channel 2 is sucked in from the suction port 1*a* of the compressor body 1 and is compressed, then the compressed air is discharged as high-pressure gas from the discharge port 1*b* to the discharge channel 3.

A water separating/recovering unit 4 for separating and recovering water from the compressed gas thus discharged is disposed in the discharge channel 3. A water separating element (not shown) is provided in the interior of the water separating/recovering unit 4. Water which is mixed in the high-pressure gas admitted into the water separating/recovering unit 4 is captured by the water separating element. The water captured by the water separating element drops by its own weight, forming a water pool portion 4*a* in an inner lower portion of the water separating/recovering unit 4.

A water circulation channel 5 is to supply the water stored in the water pool portion 4*a* of the water separating/recovering unit 4 to a water supply portion 1*c*, i.e., a portion to be supplied with water, (e.g., a compressing space formed by the screw rotors and the rotor casing which accommodates the rotors, and bearings) of the compressor body 1. In the water circulation channel 5, there are disposed a water cooler 6 for cooling water to be supplied to the compressor body 1, as well as a filter 7.

A discharge on-off valve 12 is disposed in the discharge channel 3 located between the discharge port 1*b* of the compressor body 1 and the water separating/recovering unit 4, while in the discharge channel 3 of compressed gas succeeding the water separating/recovering unit 4, there are disposed discharge stop means 8 and a pressure gauge 3*a*. Further, a water circulation on-off valve 13 is disposed in the water circulation channel 5 located between the water cooler 6 and a water supply portion 1*c* of the compressor body 1. There is formed a gas release channel 15 for communication between a gas phase portion of the water separating/recovering unit 4 and the exterior (a low pressure space in which the air or the like is present; in a package type compressor, it may be either the interior or the exterior of the package) of the water separating/recovering unit 4, and a gas release on-off valve 15*a* is disposed in the gas release channel 15.

On the other hand, the rotation of the drive motor M for the compressor body 1 is controlled with a frequency signal which is transmitted to the motor from a controller 10 via an inverter 11. More specifically, in normal operation, the controller 10 receives a detected pressure Pd from the pressure gauge 3*a* installed in the discharge channel 3 and, for controlling rotation, provides a command indicative of an appropriate number of revolutions calculated for example by PID control to the inverter 11 so that the detected pressure Pd becomes equal to a predetermined pressure.

When the compressor body 1 is in operation, the controller 10 opens the discharge on-off valve 12 and the water circulation on-off valve 13, and at the same time closes the gas release on-off valve 15*a*. On the other hand, when the compressor body 1 is not in operation, the controller 10 closes the discharge on-off valve 12 and the water circulation on-off valve 13. At the same time, the gas release on-off valve 15*a* is opened to provide communication between the gas phase portion of the water separating/recovering unit 4 and the air.

When the compressor body 1 is in operation, water and air both supplied into the compressing space of the compressor body 1 are mixed up within the compressing space. As a result, air is dissolved into the water. The internal pressures of the water separating/recovering unit 4, water circulation channel 5 and water cooler 6 during operation of the compressor body 1 are maintained at a so-called "discharge pressure" or a high pressure close thereto, so that air remains dissolved into the water present therein. However, once the gas phase portion of the water separating/recovering unit 4 and the exterior of the water separating/recovering unit 4 are brought into communication with each other, the internal pressures of the water separating/recovering unit 4, water circulation channel 5 and water cooler 6 drop, and the air which is dissolved in the water reverts to the state of gas. By the action of the air thus restored to the gaseous state, the water present within the water cooler 6 is pushed toward the water separating/recovering unit 4.

Then, the water present within the water cooler 6 is recovered into the water pool portion 4*a* of the water separating/recovering unit 4 through the water circulation channel 5. As a result, water can be removed from the water cooler 6 which is particularly apt to be damaged by freezing of water among the devices disposed in the water circulation channel 5, and thus it is possible to avoid the occurrence of a trouble such as breakage of the water cooler 6 caused by freezing.

As the discharge stop means 8 it is preferable to use an on-off valve or a check valve which is opened so as to permit compressed gas to flow in only the discharge direction of the discharge channel 3. More specifically, upon receipt of a start signal from input means (e.g., an input panel provided with a start/stop switch) (not shown), the controller 10 opens an on-off valve in the case where the discharge stop means 8 is the on-off valve and also opens the discharge on-off valve 12, allowing compressed gas to pass through the discharge channel 3. At the same time, the controller 10 opens the water circulation on-off valve 13 and closes the gas release on-off valve 15*a*, then makes the compressor body 1 start operation.

On the other hand, when there is little or no demand for compressed gas in a compressed gas destination, an operator of the water-lubricated compressor determines that such a state exists, then pushes a stop switch of the input means (not shown). The controller 10 receives this OFF signal and stops the operation of the compressor body 1. Then, the controller 10 closes an on-off valve in case of the discharge stop means 8 being the on-off valve and closes the discharge on-off valve 12 to close the discharge channel 3. At the same time, the controller 10 closes the water circulation on-off valve 13 and opens the gas release on-off valve 15*a*. As a result, the internal pressure of the water separating/recovering unit 4 drops, and by the action of air which reverts to a gaseous state from its dissolved state in water as described above, the water present within the water cooler 6 is discharged to the water pool portion 4*a* of the water separating/recovering unit 4 through the water circulation channel 5.

Alternatively, a modification may be made such that the controller 10 receives the detected pressure Pd from the pressure gauge 3*a* disposed in the discharge channel 3, then in order to maintain the detected pressure Pd at a level between preset upper-limit pressure and lower-limit pressure, the controller 10 issues a command indicative of stop or start of the compressor body 1 and, in accordance with this command, the discharge stop means 8, discharge on-off valve 12, water circulation on-off valve 13 and gas release on-off valve 15*a* are each opened or closed as described above.

According to this structure, when the operation of the compressor body 1 is stopped, the discharge stop means 8 is closed if it is an on-off valve, the discharge on-off valve 12 and the water circulation on-off valve 13 are closed and the gas release on-off valve 15*a* is opened. As a result, the internal pressures of the water separating/recovering unit 4, water circulation channel 5 and water cooler 6, the pressures being maintained at high pressure during operation, abruptly drop. Consequently, as indicated by a long dashed double-dotted line in FIG. 1, the water present within the water cooler 6 is forced back toward the water separating/recovering unit 4 through the water circulation channel 5 under the action of air which reverts to its gaseous state from such a dissolved state in water as described above.

Among the water systems, including the water circulation channel 5, it is the water separating/recovering unit 4 that can hold the largest amount of water. Under the ordinary environment, however, it is not necessary to remove all the amount of water stored in the water pool portion 4*a* of the water separating/recovering unit 4. Even with removal of only the water present within the water cooler 6 constituted by a thin-walled (0.5 mm or so) copper tube, it is sufficient for avoiding breakage caused by freezing of water.

The reason for disposing the discharge stop means 8 in the discharge channel 3 succeeding the water separating/recovering unit 4 is as follows. When the operation of the compressor body 1 is stopped, the compressed gas present within the water system comprising the water separating/recovering unit 4, water cooler 6 and water circulation channel 5 is released through the gas release channel 15, and at the same time, the water present within the water system is recovered by the water separating/recovering unit 4. At this time, even if the amount of the water thus recovered exceeds the capacity of the water pool portion 4*a* of the water separating/recovering unit 4, the water is conducted to the gas release channel 15 without getting into the discharge channel 3 and is released to the exterior of the system because the discharge channel 3 is blocked by both discharge stop means 8 and discharge on-off valve 12.

With such a structure, water can be removed from the water cooler 6 which is particularly apt to be damaged by freezing of water among the devices disposed in the water circulation channel 5, and hence it is possible to avoid the occurrence of a trouble such as breakage of the water cooler 6 caused by freezing of water.

Figure 2:
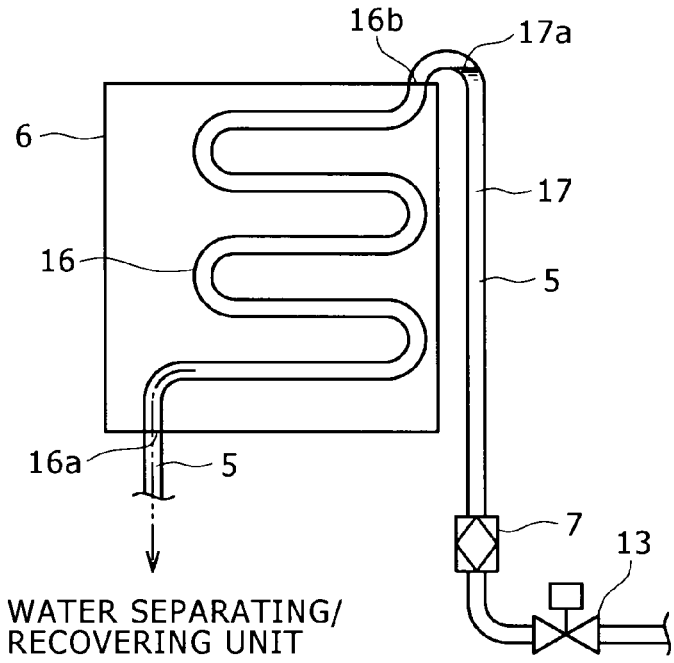
FIG. 2 is a schematic diagram for explaining an example of a water cooler used in the water-lubricated compressor of the first embodiment.

Next, the structure of the water cooler used in the first embodiment of the present invention will be described with reference to FIG. 2 and also FIG. 1. FIG. 2 is a schematic diagram for explaining an example of a water cooler used in the water-lubricated compressor according to the first embodiment of the present invention.

A copper tube 16 which constitutes a part of the water circulation channel 5 is disposed meanderingly in the interior of the water cooler 6. A cooling medium, e.g., cooling air, is put in contact with the copper tube 16, thereby the water flowing through the interior of the copper tube 16 can be cooled. While the compressor body 1 is in operation, the interior of the copper tube 16 is filled with water, but when the operation of the compressor body 1 is stopped and the internal pressure of the water circulation channel 5 drops, the air dissolved in the water reverts to a gaseous state and accumulates within the copper tube 16 located in the upper portion of the water cooler 6.

On the other hand, to avoid storing of water within the copper tube 16 in the water cooler 6 during the stop of operation of the compressor body 1, it is preferable, as shown in FIG. 2, that a water inlet 16*a*, which is a connection between the water circulation channel 5 succeeding the water separating/recovering unit 4 and the copper tube 16 disposed within the water cooler 6, be formed in a bottom position of the water cooler 6 and that the copper tube 16 be disposed within the water cooler 6 so as to occupy an upper position and become horizontal toward a downstream side. According to this structure, the air which reverts to a gaseous state from the dissolved state in water when the compressor body 1 is not in operation rises and accumulates in the upper portion within the copper tube 16, so that the water present within the copper tuber 16 is forced down and is discharged to the water separating/recovering unit 4 through the water inlet 16*a* of the water cooler 6.

Further, as shown in FIG. 2, if not only the water inlet 16*a* is formed in a bottom position of the water cooler 6, but also a water outlet 16*b* as a connection between the copper tube 16 in the water cooler 6 and the water circulation channel 5 succeeding the water cooler 6 is formed in a top position of the water cooler 6, it becomes possible to drain water while allowing only residual water 17 to remain up to a water level 17*a* within the water circulation channel 5 succeeding the water cooler 6, so that the water present within the copper tube 16 in the water cooler 6 can be discharged positively.

Thus, according to the antifreezing method for the water-lubricated compressor of the first embodiment, the discharge on-off valve 12 is disposed in the discharge channel 3 located between the discharge port 1*b* of the compressor body 1 and the water separating/recovering unit 4, and the water circulation on-off valve 13 is disposed in the water circulation channel 5 located between the water cooler 6 and the water supply portion 1*c* of the compressor body 1, while there is formed the gas release channel 15 which provides communication between the gas phase portion of the water separating/recovering unit 4 and the exterior of the water separating/recovering unit 4 and the gas release on-off valve 15*a* is disposed in the gas release channel 15.

As a result, when the compressor body 1 is in operation, the discharge on-off valve 12 and the water circulation on-off valve 13 are opened and the gas release on-off valve 15*a* is closed, while when the compressor body 1 is not in operation, the discharge on-off valve 12 and the water circulation on-off valve 13 are closed and the gas release on-off valve 15*a* is opened, thereby the water present within the water cooler 6 can be recovered to the water separating/recovering unit 4 through the water circulation channel 5. Therefore, it is possible to remove water from the water cooler 6 which is particularly apt to be damaged by freezing of water among the devices disposed in the water circulation channel 5, and hence it becomes possible to avoid the occurrence of a trouble such as breakage of the water cooler 6 caused by freezing of water.

Besides, the discharge stop means 8 is disposed in the discharge channel 3 succeeding the water separating/recovering unit 4, and since the discharge stop means 8 is an on-off valve which closes the discharge channel 3 when the compressor body 1 is not in operation or a check valve which is opened so as to permit compressed gas to flow in only the discharge direction of the discharge channel, the compressed gas present within the water system comprising the water separating/recovering unit 4, water cooler 6 and water circulation channel 5 is released through the gas release channel 15 and accordingly the water present within the water system is recovered to the water separating/recovering unit 4. At this time, even if the amount of the water thus recovered exceeds the capacity of the water pool portion 4*a* in the water separating/recovering unit 4*a*, the water is conducted toward the gas release channel 15 without getting into the discharge channel 3 and is released to the exterior of the system.

Moreover, since the water inlet 16*a* of the water cooler 6 is formed in a bottom position of the water cooler 6 and the copper tube 16 is disposed within the water cooler 6 so as to occupy an upper position or become horizontal toward the downstream side, it is possible to remove water from the copper tube 16 in the water cooler 6 in a substantially positive manner. Further, since the water outlet 16*b* of the water cooler 6 is formed in a top position of the same cooler, water can be removed positively from the copper tube 16 in the water cooler 6.

Figure 3:
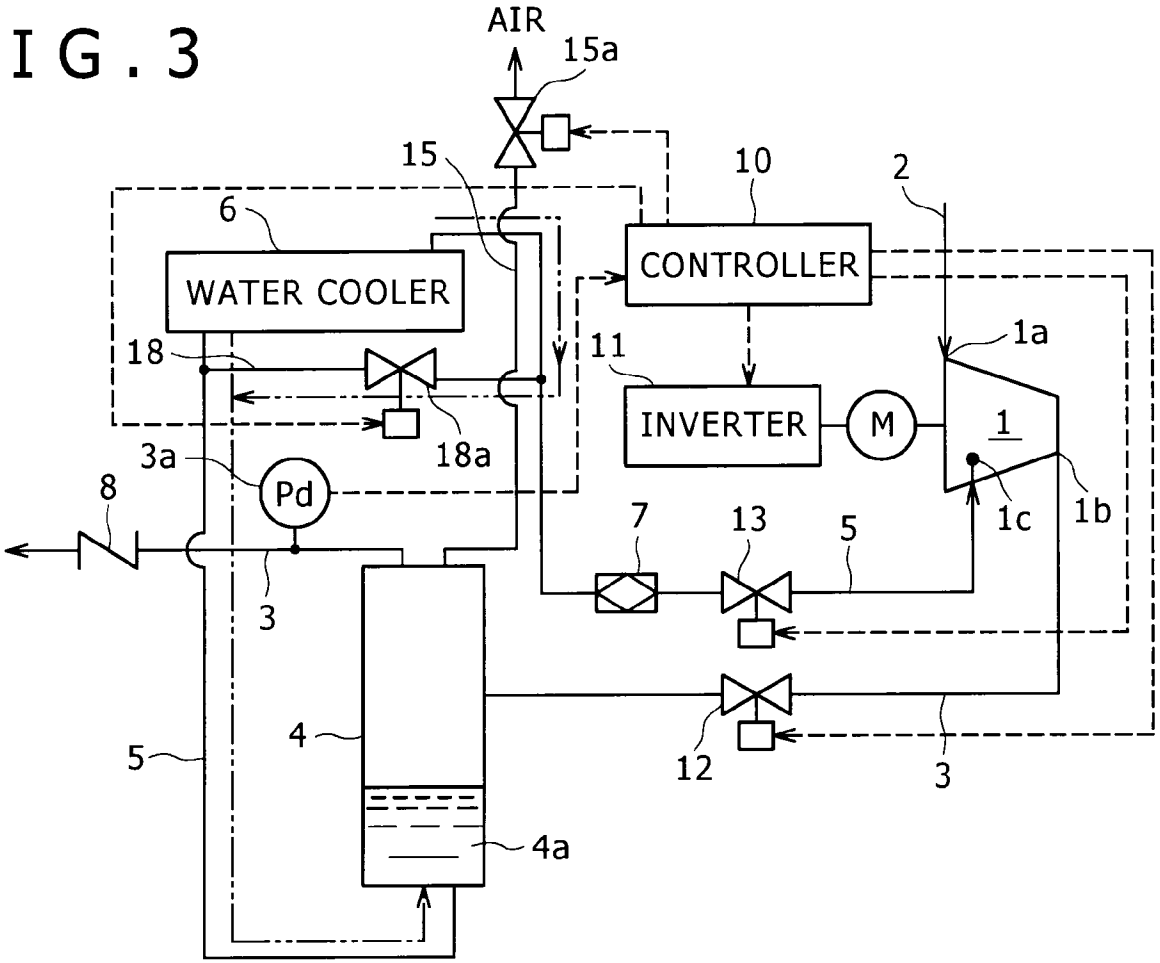
FIG. 3 is a schematic system diagram for explaining a water-lubricated compressor according to a second embodiment of the present invention.
Figure 4:
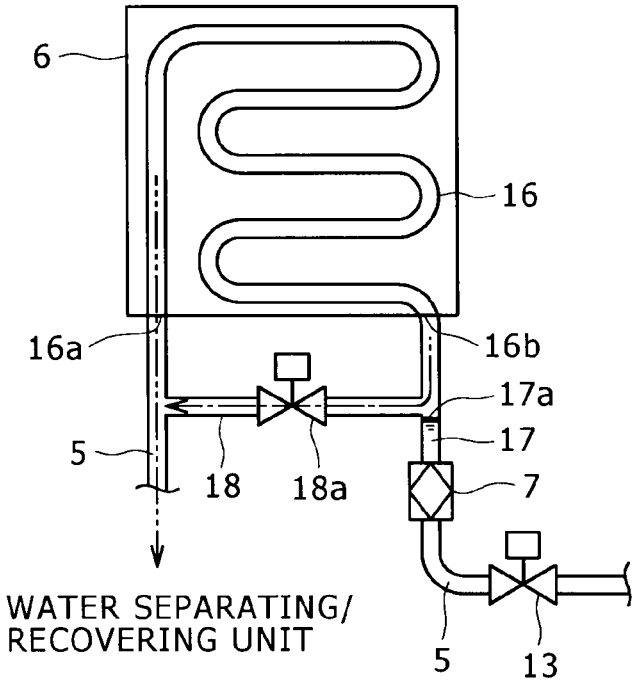
FIG. 4 is a schematic diagram for explaining an example of a water cooler used in the water-lubricated compressor of the second embodiment.
Figure 5:
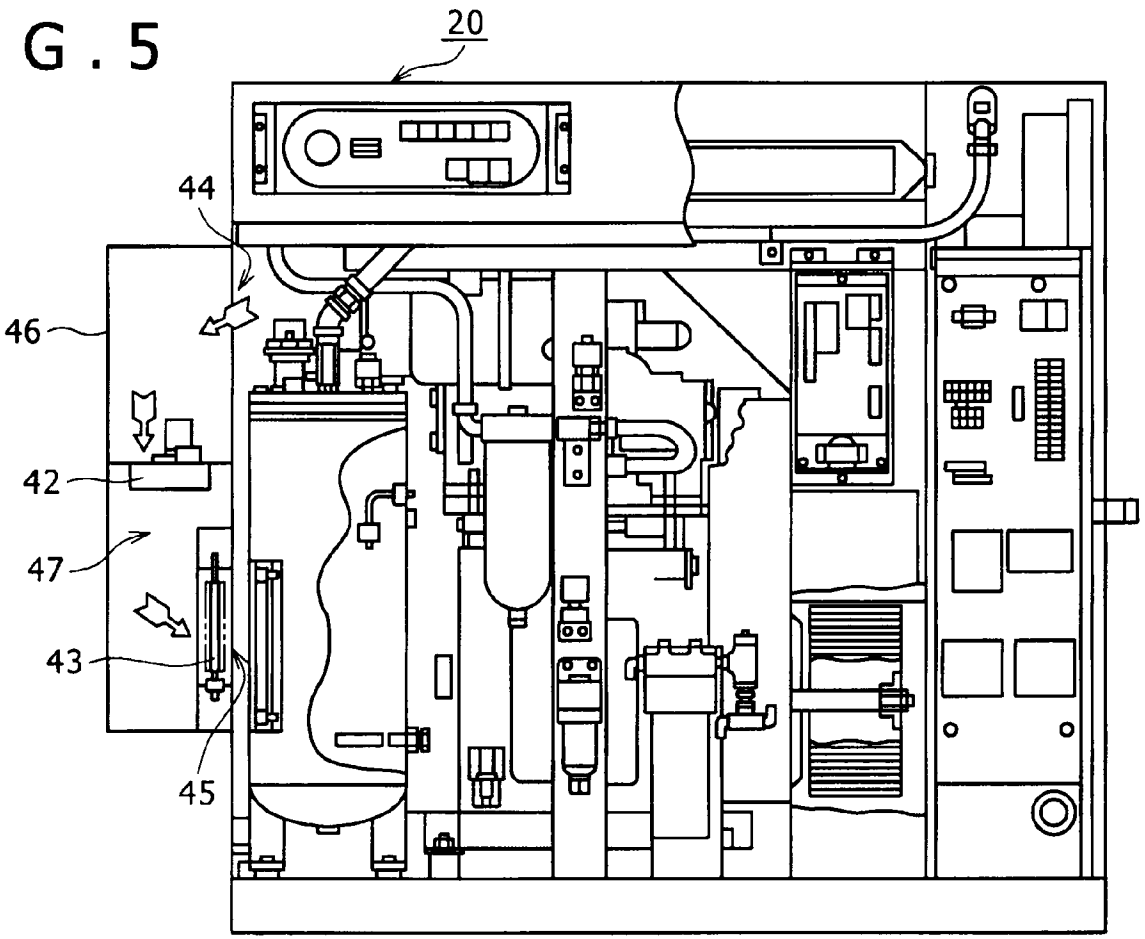
FIG. 5 PRIOR ART
FIG. 5 is a front see-through diagram of a water jet compressor equipped with a conventional antifreezing device.

Next, a water-lubricated compressor according to a second embodiment of the present invention will be described with reference to FIGS. 3, 4 and also to FIG. 1. FIG. 3 is a schematic system diagram for explaining the water-lubricated compressor of the second embodiment and FIG. 4 is a schematic diagram for explaining an example of a water cooler used in the water-lubricated compressor of the second embodiment. A difference of this second embodiment from the above first embodiment resides in a drain channel structure for the drain of water from the water cooler. Other structural points are the same as in the first embodiment, and therefore the following description will cover only the drain channel structure.

According to the drain channel structure for the drain of water from the water cooler 6 when the compressor body 1 is not in operation in the previous first embodiment, the water circulation channel 5 connected to the water inlet 16*a* of the water cooler 6 is utilized as a drain channel to recover water into the water separating/recovering unit 4. On the other hand, in the drain channel structure for the drain of water from the water cooler 6 according to this second embodiment, there is provided a bypass channel 18 for communication between the water circulation channel 5 formed between the water separating/recovering unit 4 and the water cooler 6 and the water circulation channel 5 formed between the water cooler 6 and the water circulation on-off valve 13, and a bypass on-off valve 18*a* is disposed in the bypass channel 18. When the compressor body 1 is not in operation, the bypass on-off valve 18*a* is opened by the controller 10.

With such a structure, as shown in FIG. 4, it is possible to drain water while allowing only the residual water 17 to remain up to the water level 17*a* within the water circulation channel 5 succeeding the water cooler 6 irrespective of the positions of the water inlet 16*a* and water outlet 16*b* of the water cooler 6 or the layout of the copper tube 16 in the water cooler 6. Thus, there accrues an effect that the water present within the copper tube 16 in the water cooler 6 can be discharged more positively.

As described above, in the antifreezing method for the water-lubricated compressor according to the present invention, a discharge on-off valve is disposed in the discharge channel connected to the discharge port of the compressor body and a water circulation on-off valve is disposed in the water circulation channel connected to the water outlet of the water cooler, while a gas release on-off valve is disposed in the gas release channel which provides communication between the gas phase portion of the water separating/recovering unit and the exterior of the water separating/recovering unit. When the compressor body is not in operation, the discharge on-off valve and the water circulation on-off valve are closed and the gas release on-off valve is opened. Therefore, the water present within the water cooler can be recovered to the water separating/recovering unit through the water circulation channel and thus it is possible to remove water from the water cooler which is particularly apt to be damaged by freezing of water, thereby it is possible to avoid the occurrence of a trouble such as breakage of the water cooler caused by freezing of water.

In the above embodiments, when there is little or no demand for compressed gas in the compressed gas destination, the operator of the water-lubricated compressor determines this condition and it is detected that the OFF switch of the input means is pushed, or the detected pressure Pd on the pressure gauge 3*a* rises and is detected to reach a predetermined upper-limit pressure, whereupon the removal of water in the water-lubricated compressor is started. However, the antifreezing method (water removing method) for the water-lubricated compressor according to the present invention is not limited to the above method.

For example, there may be adopted an antifreezing method wherein there is provided means for detecting the outside air temperature or the water temperature in the water separating/recovering unit 4, and when the outside air temperature or the water temperature drops to a predetermined temperature, for example when, in the case of the water temperature, it drops to 0° C. as a freezing temperature, the operation of the compressor body 1 is started, then when the detected pressure Pd detected by the pressure gauge 3*a* reaches a predetermined pressure, e.g., 0.5 MPa (a sufficient pressure for discharge of the water present in the water circulation channel), the operation of the compressor body 1 is stopped, making it possible to start the removal of water from the water-lubricated compressor. Alternatively, a forced drain switch may be provided in the input means and the removal of water from the water-lubricated compressor may be started by inputting the switch.

What is claimed is:

1. A water-lubricated compressor comprising:

a compressor body;

a water separating/recovering unit disposed in a discharge channel of said compressor body;

a water circulation channel for supplying water separated by said water separating/recovering unit to a water supply portion in said compressor body;

a water cooler disposed in said water circulation channel;

a discharge on-off valve disposed in said discharge channel at a position between a discharge port of said compressor body and said water separating/recovering unit;

a water circulation on-off valve disposed in said water circulation channel at a position between said water cooler and said water supply portion in said compressor body;

a gas release channel providing communication between a gas phase portion of said water separating/recovering unit and the exterior of said water separating/recovering unit;

a gas release on-off valve disposed in said gas release channel; and a controller adapted to make control so as to open said discharge on-off valve and said water circulation on-off valve and close said gas release on-off valve when said compressor body is in operation, and so as to close said discharge on-off valve and said water circulation on-off valve and open said gas release on-off valve when said compressor body is not in operation.

2. The water-lubricated compressor according to claim 1, wherein discharge stop means is disposed in said discharge channel succeeding said water separating/recovering unit.

3. The water-lubricated compressor according to claim 2, wherein said discharge stop means is an on-off valve adapted to close said discharge channel.

4. The water-lubricated compressor according to claim 3, wherein said controller makes control so as to close said discharge channel when said compressor body is not in operation.

5. The water-lubricated compressor according to claim 2, wherein said discharge stop means is a check valve adapted to be opened so as to permit compressed gas to flow in only a discharge direction of said discharge channel.

6. The water-lubricated compressor according to claim 1, wherein a water inlet of said water cooler is formed in a bottom position of said water cooler, and said water circulation channel located within said water cooler is disposed so as to occupy an upper position or become horizontal toward a downstream side.

7. The water-lubricated compressor according to claim 1, wherein a water outlet of said water cooler is formed in a top position of said water cooler.

8. The water-lubricated compressor according to claim 1, further comprising a bypass channel for communication between said water circulation channel located between said water separating/recovering unit and said water cooler and said water circulation channel located between said water cooler and said water circulation on-off valve, and a bypass on-off valve disposed in said bypass channel, wherein said controller opens said bypass on-off valve when said compressor body is not in operation.

* * * * *